US011851632B2

(12) United States Patent
Aissani et al.

(10) Patent No.: US 11,851,632 B2
(45) Date of Patent: Dec. 26, 2023

(54) SOLID COMPOSITION COMPRISING AN ETHOXYLATED ALCOHOL WITH FROM 30 TO 40 ETHOXY GROUPS

(71) Applicant: RECKITT BENCKISER FINISH B.V., Hoofddorp (NL)

(72) Inventors: Souhila Aissani, Heidelberg (DE); Natalia Fragoso, Heidelberg (DE); Patrick Illert, Heidelberg (DE); Torsten Roth, Heidelberg (DE); Pavlinka Roy, Heidelberg (DE); Itahisa Suarez, Heidelberg (DE); William Whittaker, Heidelberg (DE)

(73) Assignee: Reckitt Benckiser Finish B.V., Hoofddorp (NL)

( * ) Notice: Subject to any disclaimer, the term of this patent is extended or adjusted under 35 U.S.C. 154(b) by 0 days.

(21) Appl. No.: 17/998,268

(22) PCT Filed: May 12, 2021

(86) PCT No.: PCT/EP2021/062658

§ 371 (c)(1),
(2) Date: Nov. 9, 2022

(87) PCT Pub. No.: WO2021/228961

PCT Pub. Date: Nov. 18, 2021

(65) Prior Publication Data

US 2023/0193155 A1 Jun. 22, 2023

(30) Foreign Application Priority Data

May 14, 2020 (GB) ..... 2007130

(51) Int. Cl.

| | |
|---|---|
| ***C11D 1/72*** | (2006.01) |
| ***C11D 3/20*** | (2006.01) |
| ***C11D 11/00*** | (2006.01) |
| ***C11D 17/04*** | (2006.01) |
| ***C11D 17/06*** | (2006.01) |

(52) U.S. Cl.

CPC ..... *C11D 1/72* (2013.01); *C11D 3/2065* (2013.01); *C11D 11/0023* (2013.01); *C11D 17/046* (2013.01); *C11D 17/06* (2013.01)

(58) Field of Classification Search

CPC ..... C11D 1/72; C11D 3/0026; C11D 3/2065; C11D 11/0023; C11D 17/0052; C11D 17/0091; C11D 17/0095; C11D 17/043

See application file for complete search history.

(56) References Cited

U.S. PATENT DOCUMENTS

| | | | | |
|---|---|---|---|---|
| 2017/0298298 | A1* | 10/2017 | Kieffer | C11D 3/3409 |
| 2018/0015509 | A1* | 1/2018 | Carter | B08B 3/08 |
| 2018/0312787 | A1* | 11/2018 | Gelderman | C11D 3/222 |
| 2021/0071108 | A1* | 3/2021 | Kieffer | C11D 1/76 |
| 2022/0195341 | A1* | 6/2022 | McGrane | C11D 3/3738 |

FOREIGN PATENT DOCUMENTS

| | | | |
|---|---|---|---|
| DE | 102005025332 | A1 | 12/2006 |
| DE | 102018212086 | A1 | 1/2020 |
| EP | 1543763 | A1 | 6/2005 |
| EP | 2392639 | A1 | 12/2011 |
| EP | 3382001 | A1 | 12/2021 |
| WO | 92/06174 | A1 | 4/1992 |
| WO | 97/00935 | A1 | 1/1997 |
| WO | 98/58045 | A1 | 12/1998 |
| WO | 2018/113643 | A1 | 6/2018 |
| WO | 2000/060046 | A1 | 10/2020 |

OTHER PUBLICATIONS

International Search Report and Written Opinion for PCT Application No. PCT/EP2021/062658 dated Aug. 6, 2021.
Combined Search Report and Examination Report for GB Application No. 2007130.4 dated Nov. 17, 2020.
International Preliminary Report on Patentability for PCT Application No. PCT/EP/062658 dated Apr. 26, 2022.
Kolb Distribution Ltd.: "Nonionic Surfactants", pp. 1-36.
English Translation of Office Action for corresponding Chinese Application No. 202180034617.3 dated Jun. 15, 2023.
Examination Report for corresponding European Patent Application No. 21725754.2 dated Jun. 1, 2023.

* cited by examiner

*Primary Examiner* — Charles I Boyer
(74) *Attorney, Agent, or Firm* — Dunlap Codding, P.C.

(57) ABSTRACT

The present invention relates to a solid composition comprising, based on the total weight of the composition, at least 50 wt. % of an ethoxylated alcohol having a melting point higher than 20° C. It also relates to a product comprising said solid composition in the form of a powder and a container, wherein said solid composition is comprised in said container. It also relates to product comprising said solid composition and a cage, wherein said solid composition is contained in said cage. It further relates to a product comprising said solid composition and a porous solid support, wherein said solid composition is attached to said porous solid support. It further relates to a method for the controlled release of one or more actives in an automatic washing operation by providing said solid composition or any of the products to the machine in which said automatic washing operation is performed.

13 Claims, No Drawings

SOLID COMPOSITION COMPRISING AN ETHOXYLATED ALCOHOL WITH FROM 30 TO 40 ETHOXY GROUPS

CROSS-REFERENCE TO RELATED APPLICATIONS

This application is a national stage entry of, and claims priority to, PCT Application No. PCT/EP2021/062658, filed on 12 May 2021, which claims priority to GB Patent Application No. GB2007130.4, filed on 14 May 2020, the entireties of each of which are incorporated by reference herein.

The present invention relates to a solid composition comprising a matrix and one or more actives. It also relates to a product comprising said solid composition and a container, wherein said solid composition is contained in said container. It also relates to a product comprising said solid composition and a cage, wherein said solid composition is contained in said cage. It also relates to a product comprising said solid composition and a porous solid support, wherein said solid composition is attached to said porous solid support. The invention further relates to a method for the controlled release of one or more actives in an automatic washing operation.

BACKGROUND

Currently, the vast majority of automatic washing products, for example automatic dishwashing products or automatic laundry products, are single-dose products that the consumer must dose each time that they would like to experience the benefit offered by different products, examples include, mono-dose detergents, detergent gels, machine cleaners, and boosters. There are a few exceptions that provide consumers with a benefit over multiple cycles, such as conventional liquid rinse aids and dishwasher deodorants or fresheners. In cases where the consumer benefit is delivered over multiple cycles, there is only a limited range of actives that can be delivered over multiple cycles, and often these product formats do not give consumers a clear end of life indication. For example, conventional rinse aids are commonly found in the market as bottled liquids that must be used periodically to fill the designated rinse aid dispenser found inside the dishwasher. However, this task can be quite tedious for consumers as it is often difficult for consumers to know when the rinse aid reservoir needs to be replenished. The main reason for this is that automatic dishwashing machines often lack a clear visual indication to the consumer that there is a need to refill the rinse aid dispenser in the machine.

Considering automatic washing machines, such as automatic dishwashing machines and automatic laundry machines, actives to achieve a consumer benefit are normally provided as single-dose products, for example, bleach booster, cleaning performance booster, shine performance improver, material care product, antimicrobial agents, and malodor control agent.

A rinse aid in a solid format would solve the aforementioned issues linked to conveying to the consumer the need of refilling the rinse aid dispenser. This is due to the fact that the solid wax that makes up the rinse aid is a visible solid and it allows the consumer to see the product at different stages of its lifespan, and most importantly to discern when the product is used up and must be replaced.

Therefore, there is a need of a solid composition comprising one or more actives to achieve a consumer benefit that can be used during several washing cycles. This means that the solid composition must provide a controlled release of said one or more actives.

Furthermore, there is a need of a solid composition comprising one or more actives to achieve a consumer benefit capable of providing a control release of said one or more actives, said solid composition being usable during several washing cycles and providing a clear end-of-life indication to the consumer.

SUMMARY OF THE INVENTION

The present invention provides a solid composition comprising an ehtoxylated alcohol having a melting point higher than 20° C. and optionally one or more actives to achieve a consumer benefit that can be used during several washing cycles and preferably, the solid composition also provides a clear end-of-life indication. This is achieved by:

a. providing a solid composition comprising an ethoxylated alcohol having a melting point higher than 20° C., and/or
b. providing a perforated cage in which a solid composition is contained and in which parameters such as:
   - the ratio of open to closed area of the perforated cage, and/or
   - the water throughout the perforations per unit open area, and/or
   - the diameter and/or number of the perforations are controlled.

The solid composition comprising an ehtoxylated alcohol having a melting point higher than 20° C. may be presented as a powder, as a compressed powder, as a gel, as an aggregation of solids, as a continuous solid, as a non-homogeneous solid. It will be understood that by solid, it is meant a solid at room temperature, for example at temperatures lower than 50° C., preferably lower than 40° C., more preferably lower than 30° C., even more preferably lower than 25° C.

In a first aspect, the present invention relates to a solid composition comprising an ethoxylated alcohol having a melting point higher than 20° C. and described by the formula:

$$R^1[CH_2CH_2O]_zOH$$

wherein $R^1$ represents a linear or branched chain aliphatic hydrocarbon group with 14-20 carbon atoms or mixtures thereof, and z has a value between 30 and 40.

In an embodiment, $R^1$ represents a linear or branched chain aliphatic hydrocarbon group with 16-18 carbon atoms or mixtures thereof, preferably a linear chain aliphatic hydrocarbon with 16-18 carbon atoms or mixtures thereof, and wherein z has a value between 34 and 38.

Said ethoxylated alcohol may have a melting point higher than 30° C., preferably higher than 35° C.

The composition comprises at least 50 wt. % of said ethoxylated alcohol having a melting point higher than 20° C., based on the total weight of the composition, preferably at least 60 wt. %, more preferably at least 70 wt. %.

In another embodiment, said composition further comprises at least one polar organic compound having a melting point lower than 20° C., preferably a polyalcohol with a melting point lower than 20° C., more preferably glycerol.

Said composition may comprise at least 5 wt. % of said at least one polar organic compound having a melting point lower than 20° C., based on the total weight of the composition, preferably at least 10 wt. %, more preferably at least 15 wt. %, even more preferably at least 20 wt. %.

In an embodiment, said composition further comprises one or more actives.

In another embodiment, said composition comprises between 1 wt. % and 70 wt. % of said one or more actives, based on the total weight of the composition, preferably between 1 wt. % and 60 wt. %, more preferably between 1 wt. % and 50 wt. %, even more preferably between 1 wt. % and 40 wt. %.

In an embodiment, said one or more actives comprise at least one modified polyglycol ether having a melting point higher than 20° C., preferably described by the formula $R^2O[CH_2CH(CH_3)O]_x[CH_2CH_2O]_y[CH_2CH(OH)R^3]$; wherein: $R^2$ represents a linear or branched chain aliphatic hydrocarbon group with 6-16 carbon atoms or mixtures thereof; $R^3$ represents a linear or branched chain aliphatic hydrocarbon rest with 6-16 carbon atoms or mixtures thereof; x has a value between 0 and 5, preferably x is 0; and y has a value between 15 to 40, preferably between 18 to 25.

In another embodiment, said one or more actives comprise at least one non-ionic surfactant having a melting lower than 20° C., preferably at least one alkoxylated alcohol having a melting point lower than 20° C. and described by the formula $R^4[CH_2CH_2O]_wOH$; wherein: $R^4$ represents a linear or branched chain aliphatic hydrocarbon group with 10-18 carbon atoms or mixtures thereof, preferably with 12-16 carbon atoms or mixtures thereof; and w has a value between 1 and 10, preferably between 3 and 9, more preferably between 5 and 8, even more preferably 7 or 8, most preferably 8.

In another embodiment, said one or more actives comprise at least one modified polyglycol ether having a melting point higher than 20° C. and at least one non-ionic surfactant having a melting lower than 20° C., preferably at least one alkoxylated alcohol having a melting point lower than 20° C.

In another embodiment, said one or more actives comprise at least one oxidation catalyst, preferably selected from the group consisting of manganese salts, manganese proteinates, cobalt-amine catalysts, bis (N, N', N"-trimethyl 1,4,7-triazacyclononane)-tri-(μ-oxo)-dimanganese(IV) di(hexafluorophosphate)monohydrate (MnTACN) catalyst, and combinations thereof.

In an embodiment, said one or more actives comprise one or more enzymes and/or one or more builders.

In another embodiment, said one or more actives comprise one or more anti-corrosion agents.

In another embodiment, said one or more actives comprise one or more additives with antimicrobial activity selected from the groups consisting of preservatives, antimicrobial bleaching agents, probiotic bacteria, metal and metal-oxide nanoparticles, and combinations thereof.

In an embodiment, said one or more additives comprise at least one fragrance.

In another embodiment, said composition is in the form of a powder or a gel.

In an embodiment, said composition is an automatic dishwashing composition.

In a second aspect, the invention relates to product comprising the solid composition according to the first aspect and a container, wherein said composition is in the form of a powder and it is contained in said container, wherein said container has perforations with a diameter smaller than the average particle size of the composition.

In an embodiment, said container is transparent or translucid.

In a third aspect, the invention relates to a cage for the release of a composition comprising one or more actives, said cage comprising at least one side with perforations, wherein in said at least one side with perforations the ratio of the total area of the apertures or perforations to the total area without apertures or perforations of said at least one side with apertures or perforations, $A_{open}:A_{closed}$, is less than 3:1.

In an embodiment, the cage has a liquid throughput per unit open area that is less than 1 mL/(min×cm$^2$), preferably less than 0.5 mL/(min×cm$^2$), more preferably less 0.4 mL/(min×cm$^2$).

In a fourth aspect, the invention relates to a product comprising the solid composition according to the first aspect and the cage according to the third aspect, wherein said solid composition is contained is said cage.

In a fifth aspect, the invention relates to a product comprising the solid composition according to the first aspect and a porous solid support, wherein said solid composition is attached to said porous solid support.

In a sixth aspect, the invention relates to a method for the controlled release of one or more actives in an automatic washing operation by providing a composition according to the first aspect or a product according to the second aspect or a product according to the fourth aspect or a product according to the fifth aspect to the machine in which said automatic washing operation is performed.

In an embodiment, said automatic washing operation is an automatic dishwashing operation or a laundry washing operation, preferably an automatic dishwashing operation.

Definitions

The following definitions are used in the present application.

"Active", as used in the present patent application means, a material, ingredient, compound or product that provides a consumer benefit, for example, rinse aids, bleach booster, cleaning performance booster, shine performance improver, material care product, antimicrobial agents, and malodour control agent. The active can be used alone or in combination with an automatic washing detergent, for example, together with an automatic dishwashing detergent.

"Drying index" or "DI", as used in the present application means, indication of the drying performance of a formulation in a dishwashing cycle. It ranges from 0 to 1, where 0 indicates completely wet dishes and 1 indicates fully dry dishes. It is calculated according to the following equation:

$$DI = \frac{\sum S}{2 \times N} \quad \text{Eq. (1)}$$

In Eq. (1), S represents the score and N is the total number of items.

The drying index is determined by running a dishwashing cycle three times. After three cycles, the arithmetic average and the standard deviation of the drying indices are calculated. If the standard deviation is higher than 0.10 a further test cycle is recommended, and the anomalous run is excluded.

"Score" or "5", as used in the present patent application means, number giving to an item after this has been washed and dry. This is determined visually, and each item is observed for a maximum of 8 seconds. A score of 2 is given to a dry item, i.e. completely free of moisture. A score of 1 is given to an item that is not completely dry, i.e. one or two drops of water, or one wet streak and when the total wet area is less than 50 $mm^2$. A score of 0 is given to an item that is wet, i.e. more than two drops of water, or one drop and one streak, or two streaks, or water in glass or cup cavity, and when the total wet area is more than 50 $mm^2$.

"End-of-life indication", as used in the present patent application means, method used for determining the end-of-life of a composition. This can be determined calculating the "remaining area" or "% RA" of a composition or by weighing a composition before and after performing a test.

The "remaining area" or "RA" of a solid composition is given by dividing the length of the composition in a determined direction before performing a test by the length of the composition in the same direction after a certain period, normally the end of the test. For example, if the length of a solid composition before performing a test is 5 cm and the length of the composition at the end of the test in the same direction is 3 cm, then % RA=100×3/5=60%.

"Bleach score", as used in the present patent application means, evaluation of bleaching performance considering the protocol of the German Cosmetic, Toiletry, Perfume and Detergent Association (IKVV). This is done by visual comparison to a reference photographic catalogue, as mentioned in the "*Recommendations for the Quality Assessment of the Cleaning Performance of Dishwasher Detergent* (*Part B, Update* 2015)"—Instructions for Preparation—Test Soil Types—Test Procedures, sofwjournal, 142, 06/16. The bleach score ranges from 1 until 10. A bleach score of 10 is given to an item with no signs of stains and a bleach score of 1 is given to an item from which almost no stain is removed. As previously mentioned, all scores are given by comparing the test item with a reference photographic catalogue.

"Shine performance", as used in the present patent application means, scoring system for evaluating the shine performance of a product in an automatic washing operation, for example an automatic dishwashing operation. A shine performance of 5 means extremely strong spotting or filming. A shine performance of 4 means very strong spotting or filming. A shine performance of 3 means strong spotting or filming A shine performance of 2 means slightly spotting or filming. A shine performance of 1 means no spotting or filming. Shine performance is determined after 5 washing cycles and after 20 washing cycles.

"Porous solid support", as used in the present patent application means, support on which a formulation or composition is deposited or applied. It will be understood that a solid porous solid support is not a cage but just a substrate on which the formulation is applied or deposited.

DETAILED DESCRIPTION

In a first aspect the present invention relates to a solid composition comprising, based on the total weight of the composition, at least 50 wt. % of an ethoxylated alcohol having a melting point higher than 20° C. and described by the formula:

$$R^1[CH_2CH_2O]_zOH$$

wherein $R^1$ represents a linear or branched chain aliphatic hydrocarbon group with 14-20 carbon atoms or mixtures thereof, and z has a value between 30 and 40.

Preferably $R^1$ represents a linear or branched chain aliphatic hydrocarbon group with 16-18 carbon atoms or mixtures thereof, preferably a linear chain aliphatic hydrocarbon with 16-18 carbon atoms or mixtures thereof, and wherein z has a value between 34 and 38.

The melting point of the ethoxylated alcohol may be higher than 30° C., preferably higher than 35° C.

An example of a preferred ethoxylated alcohol having a melting point higher than 20° C. is the non-ionic surfactant Imbetin™-AG/168S/360G.

The composition may comprise at least 60 wt. % of said ethoxylated alcohol having a melting point higher than 20° C., based on the total weight of the composition, preferably at least 70 wt. %.

The composition may comprise, for example, 100 wt. % of said ethoxylated alcohol having a melting point higher than 20° C. This ethoxylated alcohol may be used as a matrix for other actives. In addition, this ethoxylated alcohol may also provide a consumer benefit, such as improved drying and shining performance.

The composition may further comprise at least one polar organic compound having a melting point lower than 20° C., preferably a polyalcohol with a melting point lower than 20° C., more preferably glycerol.

The present inventors have observed that when at least one polar organic compound having a melting point lower than 20° C. is added to the composition according to the invention, a solid composition in the form of a gel is obtained, which provides a better release of e.g. actives. It will be understood that a gel is a three-dimensional network that behaves like a solid, as it does not exhibit any flow when in steady state.

The composition may comprise comprises at least 5 wt. % of said at least one polar organic compound having a melting point lower than 20° C., based on the total weight of the composition, preferably at least 10 wt. %, more preferably at least 15 wt. %, even more preferably at least 20 wt. %.

The composition may further comprise one or more actives to provide a consumer benefit. The composition may comprise between 1 wt. % and 70 wt. % of said one or more actives, based on the total weight of the composition. Preferably, the composition comprises between 1 wt. % and 60 wt. % of said one or more actives, more preferably between 1 wt. % and 50 wt. %, even more preferably between 1 wt. % and 40 wt. %.

For example, said one or more actives may comprise at least one modified polyglycol ether having a melting point higher than 20° C. Without wishing to be bound to any theory, the present inventors believe that this type of non-ionic surfactants exhibits poor dispersion in the wash broth, causing them to remain at the bottom of the dishwasher at the end of the wash cycle and to be carried over to the rinse cycle where they will effectively improve the drying. Furthermore, they are waxy surfactants that are in the solid state at room temperature, which was deemed beneficial as it would allow the actives in the matrix to be released gradually throughout the product's lifespan, as opposed to being predominantly released in the first few cycles of product use. These non-ionic surfactants are rinse aids and they provide an improved drying, anti-spotting and shine-properties on hard surfaces treated with a composition comprising them. Hard surfaces can be, for example, kitchenware, walls and floors.

Preferred examples of modified polyglycol ethers are those described by the formula:

$$R^2O[CH_2CH(CH_3)O]_x[CH_2CH_2O]_y[CH_2CH(OH)R^3]$$

wherein:

$R^2$ represents a linear or branched chain aliphatic hydrocarbon group with 6-16 carbon atoms or mixtures thereof, $R^3$ represents a linear or branched chain aliphatic hydrocarbon rest with 6-16 carbon atoms or mixtures thereof, x has a value between 0 and 5, preferably x is 0 and y has a value between 15 to 40, preferably between 18 to 25.

Preferably x is 0 and y has a value between 18 to 25.

It will be understood by the person skilled in the art that these preferred examples of modified polyglycol ethers would have a melting point higher than 20° C., i.e. they are solid at room temperature.

Examples of modified polyglycol ethers having a melting point higher than 20° C. and being particularly preferred are Genapol™ EC50 and Dehypon™ E127.

The composition may comprise between 1 wt. % and 60 wt. % of said at least one non-ionic surfactant having a melting point higher than 20° C., based on the total weight of the composition, preferably between 5 wt. % and 50 wt. %, wherein preferably said at least one non-ionic surfactant having a melting point higher than 20° C. comprises of consists of at least one modified polyglycol ether having a melting point of higher than 20° C.

Said one or more actives may comprise at least one non-ionic surfactant having a melting point lower than 20° C., preferably at least one alkoxylated alcohol having a melting point lower than 20° C.

Preferred examples of alkoxylated alcohols having a melting point lower than 20° C. are those described by the formula:

$$R^4[CH_2CH_2O]_wOH$$

wherein:

$R^4$ represents a linear or branched chain aliphatic hydrocarbon group with 10-18 carbon atoms or mixtures thereof, preferably with 12-16 carbon atoms or mixtures thereof, and w has a value between 1 and 10, preferably between 3 and 9, more preferably between 5 and 8, even more preferably 7 or 8, most preferably 8.

It will be understood by the person skilled in the art that these preferred examples of alkoxylated alcohols would have a melting point lower than 20° C., i.e. they are liquid at room temperature.

Examples of alkoxylated alcohols having a melting point lower than 20° C. and being particularly preferred are those of the Lutensol™ series.

The present inventors have observed that ethoxylated alcohols having 7 ethylene oxide units have a surprisingly good performance, considering for example, rinse aid properties. A particularly preferred example of such ethoxylated alcohols is Lutensol™ TO7.

The composition may comprise between 1 wt. % and 50 wt. % of said at least one non-ionic surfactant having a melting lower than 20° C., based on the total weight of the composition, preferably between 5 wt. % and 40 wt. %, wherein preferably said at least one non-ionic surfactant having a melting point lower than 20° C. comprises or consists of at least one alkoxylated alcohol having a melting point lower than 20° C.

Preferably said one or more actives comprise at least one non-ionic surfactant having a melting point higher than 20° C., preferably at least one modified polyglycol ether having a melting point higher than 20° C., and at least one non-ionic surfactant having a melting point lower than 20° C., preferably at least one alkoxylated alcohol having a melting point lower than 20° C.

A composition comprising at least one modified polyglycol ether having a melting point higher than 20° C., and at least one non-ionic surfactant having a melting lower than 20° C., preferably at least one alkoxylated alcohol having a melting point lower than 20° C. and described by the formula $R^4[CH_2CH_2O]_wOH$; wherein: $R^3$ represents a linear or branched chain aliphatic hydrocarbon group with 10-18 carbon atoms or mixtures thereof, preferably with 12-16 carbon atoms or mixtures thereof; and w has a value between 1 and 10, preferably between 3 and 9, more preferably between 5 and 8, even more preferably 7 or 8, most preferably 8. This combination of non-ionic surfactants provides further improved drying, anti-spotting and shine performance than when only one of the above-mentioned at least one non-ionic surfactants is used.

Without wishing to be bound to any theory, the present inventors believe that polyglycol ethers, such as e.g. Genapol EC50 and Dehypon E127, are emulsifiable rather than soluble in water. By adding an alkoxylated alcohol, e.g. Lutensol TO7, to a formulation comprising one or more modified polyglycol ethers, e.g. Genapol EC50, the dispersion of the polyglycol ether in the washing liquor is increased, which leads to an improved performance of the formulation.

Said one or more actives may comprise an oxidation catalyst, preferably selected from the group consisting of manganese salts, e.g. manganese oxalate, manganese-acetate, etc, manganese-proteinates, cobalt-amine catalysts, Bis (N,N',N"-trimethyl-1,4,7-triazacyclononane)-tri-(μ-oxo)-dimanganese(IV) di(hexafluorophosphate)monohydrate (MnTACN) catalyst, and combinations thereof. The oxidation catalysts may comprise other metal compounds, such as iron or cobalt complexes.

Said one or more actives may comprise one or more enzymes and/or one or more builders, which provide an improved cleaning performance than when only an automatic washing detergent is used.

The builders may be selected from the group consisting of sodium tripolyphosphate (STPP), sodium citrate, sodium iminodisuccinate, sodium hydroxyiminodisuccinate, methylglycine diacetic acid sodium salt MGDA), and glutamic diacetic acid sodium salt (GLDA), and combinations thereof. However, the invention is not limited to these builders The enzymes may be selected from the group consisting of proteases, lipases, amylases, cellulases, pectinases, laccases, catalases, oxidases, and combinations thereof. Any suitable species of these enzymes may be used as desired.

Said one or more actives may comprise one or more anti-corrosion agents. Preferred silver/copper anti-corrosion agents are benzotriazole (BTA) or bis-benzotriazole and substituted derivatives thereof. Other suitable agents are organic and/or inorganic redox-active substances and paraffin oil. Benzotriazole derivatives are those compounds in which the available substitution sites on the aromatic ring are partially or completely substituted. Suitable substituents are linear or branch-chain C1-020 alkyl groups and hydroxyl, thio, phenyl or halogen such as fluorine, chlorine, bromine and iodine. A preferred substituted benzotriazole is tolyltriazole.

It is known to include a source of multivalent ions in detergent compositions, and in particular in automatic dishwashing compositions, for anti-corrosion benefits. For example, multivalent ions and especially zinc, bismuth and/or manganese ions have been included for their ability to inhibit such corrosion. Organic and inorganic redox-active substances which are known as suitable for use as silver/copper corrosion inhibitors are mentioned in WO 94/26860 and WO 94/26859. Suitable inorganic redox-active substances are, for example, metal salts and/or metal complexes chosen from the group consisting of zinc, manganese, titanium, zirconium, hafnium, vanadium, cobalt and cerium salts and/or complexes, the metals being in one of the oxidation states II, III, IV, V or VI. Particularly suitable metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$ and $Ce(NO_3)_3$. Any suitable source of multivalent ions may be used, with the source preferably being chosen from sulphates, carbonates, acetates, gluconates and metal-protein compounds. Zinc salts are specially preferred glass corrosion inhibitors.

Said one or more actives may comprise one or more additives with antimicrobial activity selected from the group consisting of preservatives, antimicrobial bleaching agents, probiotic bacteria, metal and metal-oxide nanoparticles, and combinations thereof.

In particular for the protection of non-metallic inorganic items, such as glassware, ceramic and enamel materials, said one or more anti-corrosion agents are selected from the group of polymers having quaternary ammonium centres known as polyquaterniums, preferably polyquaternium-2 or Urea, N,N'-bis(3-(dimethylamino)propyl)-, polymer with 1,1'-oxybis(2-chloroethane). Polyquaternium-2 has a permanent positive charge independently of the pH of the solution in which it can be present. It protects non-metallic inorganic items as mentioned before by adhering to their surfaces. An example of a compound comprising Polyquaternium-2 is Lugalvan® P.

Considering an automatic washing machine, such as and automatic dishwasher machine, which primary function is to remove food residues from dishware, a number of secondary benefits are also valued by the consumer. As an example, it is common practice to place infant's feeding items in the dishwasher to help prevent contamination due to germs. The combination of high wash temperatures, strongly oxidizing bleaching agents and enzymes in ADW detergents is thus an established method to reduce growth of viruses, bacteria, parasites and fungi stemming from the outside environment. However, not all formulations and product formats available on the market today provide full protection and the desired sanitization benefits that the consumer is expecting. Therefore, formulations lacking a comprehensive bleach system (e.g. ADW detergent gels) and/or appropriate dishwasher operating conditions (e.g. short, low temperature wash cycles) may result in inadequate hygienic conditions in the machine.

A composition according to the present invention further comprising one or more additives with antimicrobial activity selected from the group consisting of preservatives, antimicrobial bleaching agents, probiotic bacteria, metal and metal-oxide nanoparticles, and combinations thereof, leads to an improvement of the hygienic conditions in an automatic washing machine, preferably an automatic dishwashing machine.

The preservatives may be selected from the group consisting of antimicrobials used to control bacterial, algae and fungi in household consumer products based on isothiazolinone The antimicrobial bleaching agents are known to display a strong anti-microbial profile. These antimicrobial bleaching agents may be selected from the group consisting of peracid precursor compounds, stable peracids, and combinations thereof. For example, peracetic acid generated in situ from TAED and hydrogen peroxide is a potent source of antimicrobial efficacy. Examples of peracid precursor compounds are tetraacetyl ethylene diamine (TAED), sodium 3,5,5-trimethyl hexanoyloxybenzene sulphonate, diperoxy dodecanoic acid, nonylamide of peroxyadipic acid, n-nonanoyloxybenzenesulphonate (NOBS), and dodecanoyl oxybenzene sulphonate (DOBS).

Examples of a stable peracids are perbenzoic acid and peroxycarboxylic acids.

Furthermore, selected probiotics display an observable activity over a range of pathogenic, carcinogenic and conditionally pathogenic microorganisms. In addition, probiotic bacteria in their spore form are well-known to be stable in harsh environments. With other words, selected probiotics would be stable in harsh environments, whilst also exhibiting antimicrobial activity in an automatic washing operation, for example, an automatic dishwashing operation or an automatic laundry operation.

Examples of probiotics are probiotic selected from *Bacillus megaterium, Bacillus amyloliqueiaciens, Bacillus subtillis,* and *Bacillus pumilus.*

Several meta species are known to exhibit a long-term antibacterial and biofilm prevention properties. Due to their catalytic mode of action—bactericidal properties arise through the generation of reactive oxygen species—an inclusion of metal and/or metal-oxide nanoparticles in a slow-dissolving matrix is possible, as well as an immobilization in or on the surface of the cage or container.

Said one or more actives may comprise at least one fragrance for controlling malodour.

The composition may be in the form of a powder or a gel.

Preferably, the composition is an automatic dishwashing composition.

It will be understood that the composition according to the invention can be used during several washing and/or rinsing cycles, for example at least 5 washing or rising cycles or at least 10 washing or/rinsing cycles or at least 15 washing or rinsing cycles or at least 20 washing or rinsing cycles or at least 25 washing or rinsing cycles.

In a preferred embodiment, the composition is a solid rinse aid composition, wherein said composition can be used for at least 5 washing or rising cycles or at least 10 washing or/rinsing cycles or at least 15 washing or rinsing cycles or at least 20 washing or rinsing cycles or at least 25 washing or rinsing cycles. Said solid rinse aid composition providing improved drying performance and/or corrosion protection of non-metallic solid surfaces.

It should be noted that formulations according to the first aspect of the invention comply with the REACH regulation of the EU. REACH is the acronym for Registration, Evaluation, Authorisation and Restriction of Chemicals. This regulation was proposed for the protection of human health and protection of the environment. Therefore, it forces the use of potentially toxic substances to be phased out.

In a second aspect, the present invention relates to a product comprising the solid composition according to the first aspect and a container, wherein said composition is in the form of a powder and it is contained in said container and wherein said container has perforations with a diameter smaller than the average particle size of the composition.

In an embodiment, said container is transparent or translucid.

In an embodiment the container is made of a solid material that is insoluble in water. For example, a polymer, a metal, a biopolymer such as hard-pressed plant fibres, a ceramic material or glasses. Preferably the container is made of plastic.

In a third aspect, the present invention relates to a cage for the release of a composition comprising one or more actives, said cage comprising at least one side with perforations, wherein in said at least one side with perforations the ratio of the total area of the apertures or perforations ($A_{open}$) to the total area without apertures or perforations ($A_{closed}$) of said at least one side with apertures or perforations, i.e. $A_{open}$:$A_{closed}$, is less than 3:1.

Preferably in said at least one side with perforations $A_{open}$:$A_{closed}$, is less than 2:1, more preferably less than 1.8:1.

The ratio $A_{open}$:$A_{closed}$ is directly related to the liquid throughput per unit open area that the cage allows. Considering automatic washing operations, this liquid is water, and the liquid throughput per unit open area may be less than 1 mL/(min×cm$^2$), preferably less than 0.5 mL/(min×cm$^2$), more preferably less 0.4 mL/(min×cm$^2$).

The perforations of said at least one side with perforations may have a circular shape, a rectangular shape, elliptical shape, triangular shape, polyhedral shape, and combinations thereof, preferably the perforations have a circular shape.

In an embodiment the perforations of said at least one side with perforations have a circular shape with a diameter of between 0.1 cm and 5 cm, preferably between 0.25 cm and 4 cm, more preferably between 0.5 cm and 3 cm, even more preferably between 0.5 cm and 2 cm.

For example, said cage may have at least one side with perforations and all other sides without perforations, in which case it is possible to separate two or more sides of the cage to fill it in with a composition comprising one or more actives.

The present inventors have observed that by controlling parameters such as $A_{open}$:$A_{closed}$ and/or the liquid throughput per unit open area in the cage according to the second aspect, this cage allows for the controlled release of a composition, for example, in an automatic washing machine, preferably an automatic dishwashing machine.

In an embodiment the cage is made of a solid material that is insoluble in water. For example, a polymer, a metal, a biopolymer such as hard-pressed plant fibres, a ceramic material or glasses. Preferably the cage is made of plastic.

The cage according to the third aspect can be used in an automatic washing machine, for example an automatic dishwashing machine, for the controlled release of a composition comprising one or more actives.

In a fourth aspect, the present invention relates to a product comprising the solid composition according to the first aspect and the cage according to the third aspect, wherein said composition is contained in said cage.

The present inventors have observed that optimum controlled release of the solid composition according to the first aspect can be obtained when $A_{open}$:$A_{closed}$ is less than approximately 1.80:1 and/or when the liquid throughput per unit open area is less than approximately 0.40 mL/(min×cm$^2$).

It will be understood that the composition is preferably in the form of a continuous solid or a gel and that it will fill the whole internal volume of the cage.

In a fifth aspect, the present invention relates to a product comprising the solid composition according to the first aspect and a porous solid support, wherein said solid composition is attached to said porous solid support.

In an embodiment the porous solid support has a mesh with an average pore size of between 0.5 mm and 5 mm, preferably between 1 mm and 2.5 mm, more preferably between 1 mm and 2 mm.

In a sixth aspect, the present invention relates to a method for the controlled release of one or more actives in an automatic washing operation by providing a composition according to the first aspect or a product according to the second aspect or according to the third aspect or according to the fourth aspect to the machine in which said automatic washing operation is performed.

Preferably said automatic washing operation is an automatic dishwashing operation or a laundry washing operation, more preferably an automatic dishwashing operation.

The invention will be further described with the reference to the following non-limiting examples.

EXAMPLES

Formulations

A formulation consisting of a powder of a C16-C18 ethoxylated alcohol was prepared, as shown in Table 1. Fifteen grams of this formulation were placed in a plastic container (Somat Deo Duo-Pearls—previously emptied). The container has a pearl shape and perforations with a diameter much smaller than the average particle size of the powder.

TABLE 1

Formulations with a solid ethoxylated alcohol.

| Ingredient | Formulation (wt. %) F1 |
|---|---|
| C16-C18 alcohol with approximately 36 EO | 100 |

The person skilled in the art will understand that actives can be added to the formulation in Table 1.

The following formulation, as shown in Table 2, was prepared in order to determine its ability to provide a controlled-release and an end-of-life indication. This formulation was prepared by mixing the ingredients at a temperature of between 50° C. and 60° C. to obtain a flowable mixture and pouring the mixture into a plastic cage and allow it to solidify at a temperature of about 20° C. The weight of the mixture that was casted was 40g.

The cage had one side without apertures and one side with circular apertures, so that the total open surface area of the side with apertures is 26.21 cm$^2$, of a total area of 41.1 cm$^2$. Thanks to the apertures in the cage it was possible to determine the end-of-life of the formulations.

TABLE 2

Formulations with a solid ethoxylated alcohol and a polar organic compound with a melting point lower than 20° C.

| Ingredient | Formulation (wt. %) F2 |
|---|---|
| C16-C18 alcohol with approximately 36 EO | 78.00 |
| Glycerol, 99% | 22.00 |

All formulations comply with REACH regulations in the EU.

Performance Tests

The end-of-life indication of the formulation of Table 1, is given by weighing the solid composition after each cycle. Tests were performing by running washing cycles according to the following protocol in an empty ADW machine:

Machine: EU Miele GSL2

Program: P1/8 min

Water hardness: 21° dH

TABLE 3

End-of-life indication of formulations with an ethoxylated alcohol

| | Weight (g) after cycle | | | | | |
|---|---|---|---|---|---|---|
| Formulation | 0 | 1 | 2 | 3 | 4 | 5 |
| F1 | 27.52 | 21.56 | 19.95 | 19.65 | 15.38 | 14.96 |

The values in Table 3 correspond to the weight of the formulation together with the container.

Table 3 shows that a product comprising a powder and a container provides controlled release of the formulation. Furthermore, because the container is transparent or translucid, the product shows a clear end-of-life of the formulation.

Furthermore, the non-ionic surfactant in Table 1, can be used not only as a matrix, but it also provides consumer benefit, namely, improved drying and shine performance.

The end-of-life indication of the formulation shown in Table 2, is given by weighing the solid composition after each cycle. Tests were performed by running washing cycles according to the following protocol in a loaded ADW machine:

Machine: EU Miele GSL2

Programme: P1/8 min

Water hardness: 21° dH

Formulation F2 was placed in the lower rack of the ADW machine and 5 cycles were run. After each cycle, the formulation was weighed. The weight of the formulation after each cycle is shown in Table 4.

TABLE 4

End-of-life indication of formulations with a solid ethoxylated alcohol and a polar organic compound with a melting point lower than 20° C..

| | Weight (g) after cycle | | | | | |
|---|---|---|---|---|---|---|
| Formulation | 0 | 1 | 2 | 3 | 4 | 5 |
| F2 | 40 | 27.29 | 25.45 | 23.58 | 19.31 | 16.07 |

Table 4 shows that the solid composition is able to last for at least 5 cycles. Extrapolating from the average weight loss excluding the first cycle, the gel is estimated to last for around 14 cycles. With other words, formulation F2 provides a controlled release and also provides a clear end-of-life indication.

Hence one or more objects of the present invention are achieved by the present which is further elucidated in the appended claims.

The invention claimed is:

1. A solid composition comprising:

at least 70 wt. % of an ethoxylated alcohol having a melting point higher than 20° C., based on the total weight of the solid composition, and described by the formula:

$R^1[CH_2CH_2O]_zOH$ wherein $R^1$ represents a linear or branched chain aliphatic hydrocarbon group with 14-20 carbon atoms or mixtures thereof, and z has a value between 30 and 40; and at least 5 wt. % of glycerol based on the total weight of the solid composition, wherein the solid composition is an automatic dishwashing composition.

2. The solid composition according to claim 1, wherein $R^1$ represents a linear or branched chain aliphatic hydrocarbon group with 16-18 carbon atoms or mixtures thereof, preferably a linear chain aliphatic hydrocarbon with 16-18 carbon atoms or mixtures thereof, and wherein z has a value between 34 and 38.

3. The solid composition according to claim 1, wherein said ethoxylated alcohol has a melting point higher than 30° C., preferably higher than 35° C.

4. The solid composition according to claim 1, wherein said solid composition further comprises from 1 to 25% of one or more actives.

5. The solid composition according to claim 4, wherein said one or more actives comprise at least one modified polyglycol ether having a melting point higher than 20° C., preferably described by the formula $$R^2O[CH_2CH(CH_3)O]_x[CH_2CH_2O]_y[CH_2CH(OH)R^3];$$

wherein: $R^2$ represents a linear or branched chain aliphatic hydrocarbon group with 6-16 carbon atoms or mixtures thereof; $R^3$ represents a linear or branched chain aliphatic hydrocarbon rest with 6-16 carbon atoms or mixtures thereof; x has a value between 0 and 5, preferably x is 0; and y has a value between 15 to 40, preferably between 18 to 25.

6. The solid composition according to claim 4, wherein said one or more actives comprise at least one non-ionic surfactant having a melting lower than 20° C., preferably at least one alkoxylated alcohol having a melting point lower than 20° C. and described by the formula $R^4[CH_2CH_2]_wOH$;

wherein: R4 represents a linear or branched chain aliphatic hydrocarbon group with 10-18 carbon atoms or mixtures thereof, preferably with 12-16 carbon atoms or mixtures thereof; and w has a value between 1 and 10, preferably between 3 and 9, more preferably between 5 and 8, even more preferably 7 or 8, most preferably 8.

7. The solid composition according to claim 4, wherein said one or more actives comprise:

at least one oxidation catalyst, preferably selected from the group consisting of manganese salts, manganese proteinates, cobalt-amine catalysts, bis(N,N',N"-trimethyl-1,4,7-triazacyclononane)-tri-(μ-oxo)-dimanganese(IV) di(hexafluorophosphate)monohydrate (Mn-TACN) catalyst, and combinations thereof; and/or one or more enzymes; and/or one or more builders; and/or one or more anti-corrosion agents; and/or one or more additives with antimicrobial activity selected from the groups consisting of preservatives, antimicrobial bleaching agents, probiotic bacteria, metal and metal-oxide nanoparticles, and combinations thereof; and/or at least one fragrance.

8. The solid composition according to claim 1, wherein said solid composition is in the form of a powder or a gel.

9. A product comprising the solid composition according to claim 1 and a container, wherein said solid composition is in the form of a powder and said solid composition is contained in said container, wherein said container has perforations with a diameter smaller than the average particle size of the solid composition, and wherein preferably said container is transparent or translucid.

10. A product comprising the solid composition according to claim 1 and a cage, wherein said solid composition is contained in said cage and said cage comprises at least one side with perforations, wherein in said at least one side with perforations the ratio of the total area of the apertures or perforations to the total area without apertures or perforations of said at least one side with apertures or perforations, $A_{open}:A_{closed}$, is less than 3:1 and wherein the liquid throughput per unit open area is less than 1 mL/(min×cm$^2$), preferably less than 0.5 mL/(min×cm$^2$), more preferably less 0.4 mL/(min×cm$^2$).

11. A product comprising the solid composition according to claim 1 and a porous solid support, wherein said solid composition is attached to said porous solid support.

12. A method for the controlled release of one or more actives in an automatic washing operation by providing a composition according to claim 1 to a machine in which said automatic washing operation is performed.

13. The method according to claim 12, wherein said automatic washing operation is an automatic dishwashing operation.

* * * * *